United States Patent [19]

Rohr et al.

[11] Patent Number: 4,807,548

[45] Date of Patent: Feb. 28, 1989

[54] ELECTRIC MOTOR DRIVE FOR A SEWING MACHINE, ESPECIALLY AN INDUSTRIAL SEWING MACHINE

[75] Inventors: Gustav Rohr, Nussloch; Gerd Nohl, Rauenberg, both of Fed. Rep. of Germany

[73] Assignee: Frankl & Kirchner GmbH & Co. KG, Schwetzingen/Baden, Fed. Rep. of Germany

[21] Appl. No.: 121,700

[22] Filed: Nov. 17, 1987

[30] Foreign Application Priority Data

Dec. 11, 1986 [DE] Fed. Rep. of Germany ..... 3642277

[51] Int. Cl.[4] ..... D05B 69/12

[52] U.S. Cl. ..... 112/220; 112/275

[58] Field of Search ..... 112/220, 221, 275, 277, 112/121.11, 67, 87

[56] References Cited

U.S. PATENT DOCUMENTS 4,262,614 4/1981 Sugaya et al. ..... 112/275 X 4,453,624 6/1984 Graham ..... 112/220 X 4,586,448 5/1986 Lerch et al. ..... 112/275

FOREIGN PATENT DOCUMENTS 0182997 9/1985 Japan ..... 112/220

*Primary Examiner*—Peter Nerbun

*Attorney, Agent, or Firm*—Felfe & Lynch

[57] ABSTRACT

In a drive for a sewing machine, especially an industrial sewing machine, with a needle that can be reciprocated between an upper and lower end position by a sewing machine main shaft, in which the drive is in direct driving connection with the main shaft and can be controlled at variable speed through a control system, provision is made for improving the dynamic performance of the combination of drive and sewing machine by equipping it with at least one input switch connected electrically to the control system for the input of command pulses for the step-wise actuation of the drive such that with each command pulse a certain, defined amount of movement of the drive and hence of the main shaft is triggered.

3 Claims, 1 Drawing Sheet

Figure 1:
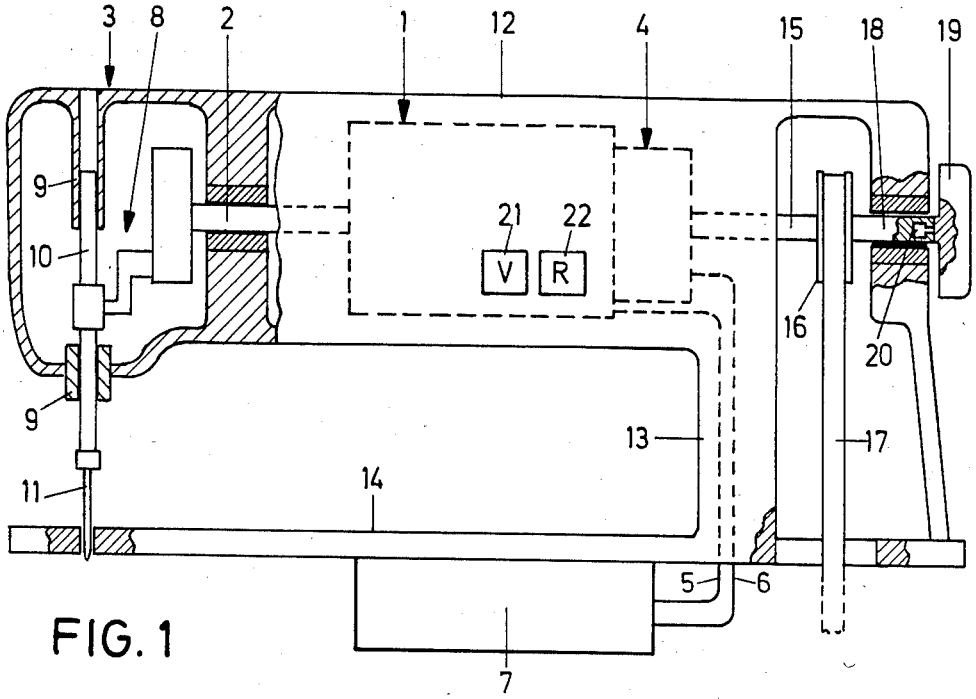

ELECTRIC MOTOR DRIVE FOR A SEWING MACHINE, ESPECIALLY AN INDUSTRIAL SEWING MACHINE

The invention relates to an electric motor drive for a sewing machine, especially an industrial sewing machine with a needle that can be reciprocated between an upper and lower end position by a sewing machine main shaft, the drive being in a direct driving connection with the needle and being controllable in speed by a control system.

Conventionally, industrial sewing machines are to a great extent indirectly driven. This means that the driving electric motor runs at constant speed in the operating state, precisely like a flywheel in driving connection with it. By means of an electromagnetic clutch-brake system the main shaft of the sewing machine can be coupled to the flywheel by alternately energizing a clutch or brake coil, the moment of inertia of the brake-clutch system being approximately again as great as that of the sewing machine itself.

In direct drives of the kind in question, the drive motor accelerates or slows down in synchronism with the main shaft. Accordingly, the timing of the overall system of drive and sewing machine are substantially codetermined by the moments of inertia of the shafts being accelerated in each case.

Setting forth from these facts the invention is addressed to the problem of achieving a reduction of the moments of inertia in order to improve the dynamic performance of the drive.

In accordance with the invention, an electric motor drive for a sewing machine, especially an industrial sewing machine, with a needle that can be moved up and down between an upper and lower end position by a sewing machine shaft, comprises a drive motor in direct driving connection with the main shaft and a control system for varying the rotational speed of the drive. The drive also includes at least one input switch directly connected with the control system for the input of command pulses for the step-wise operation of the drive such that each command pulse actuates a certain, defined amount of movement of the drive and hence of the main shaft.

The input switch is, therefore, provided in addition to the customary foot-pedal control of the main shaft speed of a sewing machine and, starting out from the state of rest of the main shaft of the sewing machine, serves to bring the needle under manual control into a certain defined position. At the same time the defined amount of movement which is triggered by the operation of the input switch can be an absolutely given amount, i.e., at a certain number of degrees of angle of rotation of the main shaft, or such that a particular end position, e.g., needle height, is reached, or also set by the fact that it is predetermined by the duration of the operation of the input switch.

Accordingly, the provision of a hand wheel which conventionally permits the manual setting of a certain needle position, e.g., for adjustments or for the threading of the needle, is rendered unnecessary by such an input pushbutton. Since the conventional hand wheels and belt pulleys on the one hand have a high moment of inertia, and on the other hand are in a direct driving connection to the main shaft of a sewing machine, the measure taken according to the invention achieves a very important reduction of the moment of inertia and with it an improvement of the performance of the drive. In the case of acceleration and retardation times given by the technical standard, the reduction of the moments of inertia to be overcome also reduces the power absorbed during the acceleration or retardation phase. Consequently lower-power components can be used in the power output amplifier of the drive, which contributes greatly to a reduction of the cost of manufacture. Further, the efficiency of the drive is improved, and on the other hand the costly power taken from the mains is reduced.

In further development of the invention, it is anticipated that two input switches preferably are provided in the form of momentary contact switches, one of which serves to trigger command pulses for moving the drive in a first direction, and the second to trigger command pulses for moving the drive in a second direction.

In this embodiment, therefore, the defined amount of drive movement preferably is preset in the form of absolute degrees of angular rotation. By the selective or alternate actuation of the two switches a forward or backward movement of corresponding amounts can be achieved, and with it a corresponding upward and downward movement of the needle, so that a specific, desired needle position can be set with great sensitivity.

Advantageously, provision preferably is made for a hand wheel to be placed removably on a shaft that is in driving connection to a drive shaft of the drive. In this manner it is possible, for certain purposes outside of normal sewing operation, e.g., for adjustment purposes by a service person, to install a hand wheel and set the needle in a particular position by means of this hand wheel, in a conventional manner.

Likewise, in normal operation the hand wheel can be eliminated so that the protective guards required for it do not have to be provided.

For a better understanding of the invention, together with other and further objects thereof, reference is made to the following description, taken in connection with the accompanying drawings, and its scope will be pointed out in the appended claims.

Figure 2:
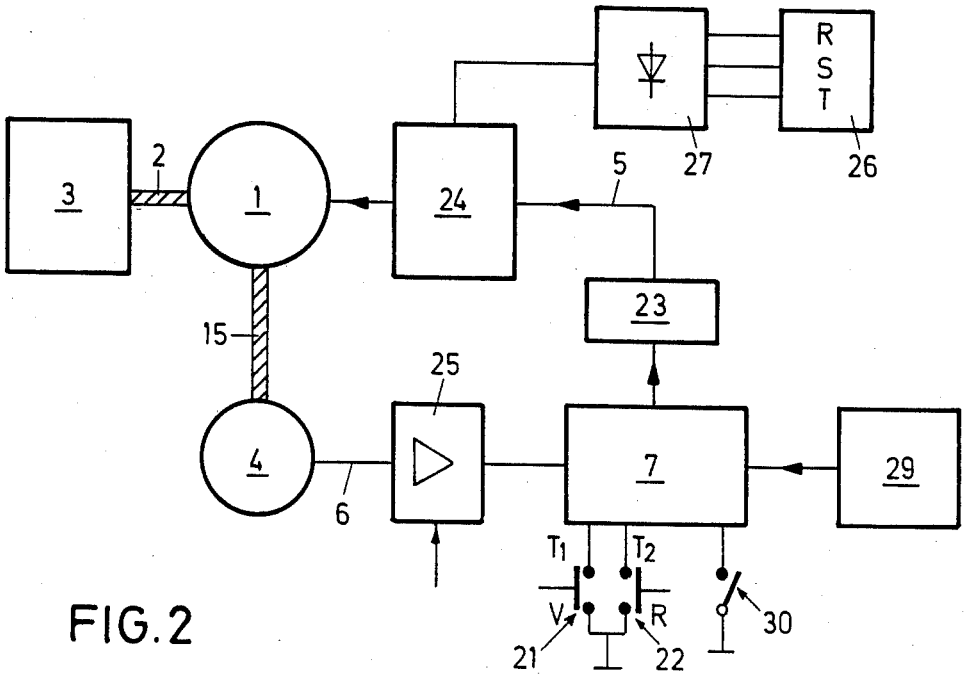

Referring now to the drawings:

FIG. 1 is a partially cut-away diagrammatic view of a drive with control system according to the invention, disposed on a sewing machine; and FIG. 2 is a block circuit diagram of a circuit used in the drive according to the invention.

In FIG. 1, an electric motor direct drive 1 is indicated only diagrammatically, because the detailed configuration of this drive is not necessary to an understanding of the embodiment of the invention. For example, a direct-current motor can be provided as the drive 1 whose drive shaft is in line with the main shaft 2 of the sewing machine 3 diagrammatically represented in FIG. 1. With the drive 1 there preferably is associated a rotary speed governor and positioner 4 known in themselves. Drive 1 and the governor and positioner 4 preferably are connected by conductors 5 and 6 to a control system 7.

The sewing machine 3 has, for example, in a manner known in itself a crank drive 8 driven by the main shaft 2, by which a needle bar 10 bearing a needle 11 on its bottom extremity and mounted in a bearing 9 is driven up and down.

A housing 12 of the sewing machine preferably is joined through a housing pedestal 13 to a base plate 14.

A shaft section 15 aligned with the main shaft 2 preferably bears a belt pulley 16 which through a V-belt 17 drives a bottom shaft, not shown, of the sewing machine 3.

At the rear end 18 of the shaft section 15 a hand wheel 19 preferably is mounted by means of a key coupling 20 which is indicated only diagrammatically, so as to be co-rotational with the shaft section 15 but removable axially.

On the outside of the housing 12 of the sewing machine, in the area of the integrated drive 1, two momentary contact switches preferably are provided as input switches 21 and 22, which serve to trigger a forward and backward movement, respectively, of the main shaft 2 through the drive 1, and a corresponding up-and-down movement of the needle 11.

In the block circuit diagram represented in FIG. 2 the mechanical driving connection between sewing machine 3 and the drive 1 preferably in the form of a direct-current motor is represented.

The control system 7 preferably is connected by a driver stage 23 and a final power amplifier 24 to the drive 1.

The speed governor and positioner 4 preferably are mechanically connected to the drive 1, e.g., by a common shaft section 15. The speed governor and positioner 4 preferably are connected by the conductor 6 through an amplifier and pulse generator 25 to the control system 7.

The mains voltage preferably is fed through a power supply system 26 and a rectifier 27 through conductor 28 to the final power amplifier 24.

Connected to the control system 7 preferably is a speed governor controller 29 as well as a reversing switch 30 and the two input switches 21 and 22 which are in the form of momentary contact switches and operate such that when they are alternately actuated the drive will be made to run stepwise leftward or rightward.

By the configuration described above it is possible in normal operation to work without the hand wheel 19 and still be able to produce the necessary needle positioning, e.g., for threading the needle. Separate safety measures, such as guards for the hand wheel, are unnecessary.

For mechanical servicing the hand wheel 19 can be installed for the performance of mechanical adjusting operations.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. An electric motor drive for a sewing machine, especially an industrial sewing machine, with a needle that can be moved up and down between an upper and lower end position by a sewing machine main shaft, the drive comprising:

a drive motor in direct driving connection with the main shaft;

a control system for varying the rotational speed of the drive; and two input switches in the form of momentary contact switches to energize the drive when the sewing machine is stopped with the needle randomly positioned, one switch serving to trigger command pulses for a movement of the drive in a first direction and the second switch triggering command pulses for a movement of the drive in a second direction.

2. An electric motor drive according to claim 1, which includes a shaft portion in driving connection with the drive shaft of the drive and a handwheel removably placeable on said shaft portion.

3. An electric motor drive for a sewing machine, especially an industrial sewing machine, with a needle that can be moved up and down between an upper and lower end position by a sewing machine main shaft, the drive comprising:

a drive motor in direct driving connection with the main shaft;

a control system for varying the rotational speed of the drive;

two input switches in the form of momentary contact switches to energize the drive when the sewing machine is stopped with the needle randomly positioned, one switch serving to trigger command pulses for a movement of the drive in a first direction and the second switch triggering command pulses for a movement of the drive in a second direction, and a shaft portion in driving connection with the drive shaft of the drive and a handwheel removably placeable on said shaft portion, thus so that said handwheel is removed in the normal operating condition of the drive and that said handwheel is attached when adjustment operations are to be performed.

* * * * *